United States Patent [19]

Seragnoli

[11] 4,141,265

[45] Feb. 27, 1979

[54] CLEANING AND LUBRICATING FOIL CUTTER

[75] Inventor: Enzo Seragnoli, Bologna, Italy

[73] Assignee: G. D. Societa per Azioni, Bologna, Italy

[21] Appl. No.: 781,523

[22] Filed: Mar. 25, 1977

[30] Foreign Application Priority Data

Mar. 31, 1976 [IT] Italy ..... 3390 A/76

[51] Int. Cl.[2] ..... B26D 7/08; B26D 1/40

[52] U.S. Cl. ..... 83/169; 83/341

[58] Field of Search ..... 83/169, 345, 22, 284, 83/341, 343, 344, 345

[56] References Cited

U.S. PATENT DOCUMENTS

| | | | |
|---|---|---|---|
| 3,431,830 | 3/1969 | Stovall | 83/343 |
| 3,543,623 | 12/1970 | Wirstroem | 83/169 |
| 3,709,077 | 1/1973 | Trogan | 83/345 |

*Primary Examiner*—Donald R. Schran

*Attorney, Agent, or Firm*—Browdy and Neimark

[57] ABSTRACT

A device for cutting a roll of foil into lengths in a packet cigarette packer, comprises one or more couples of continuous feed wheels for the foil roll along and between fixed guides and a couple of cutting blades placed opposite each other below the feed wheels of which one at least possesses continuous rotatory movement round an axis parallel to the same feed wheels. A pad of absorbent material in cylindrical form supported freely turning round its own axis is set parallel to the axis of rotation of the turning blade in position such that during its rotatory movement the turning blade comes into contact with the cylindrical pad of absorbent material pre-soaked in vaseline oil, a lubricant.

2 Claims, 1 Drawing Figure

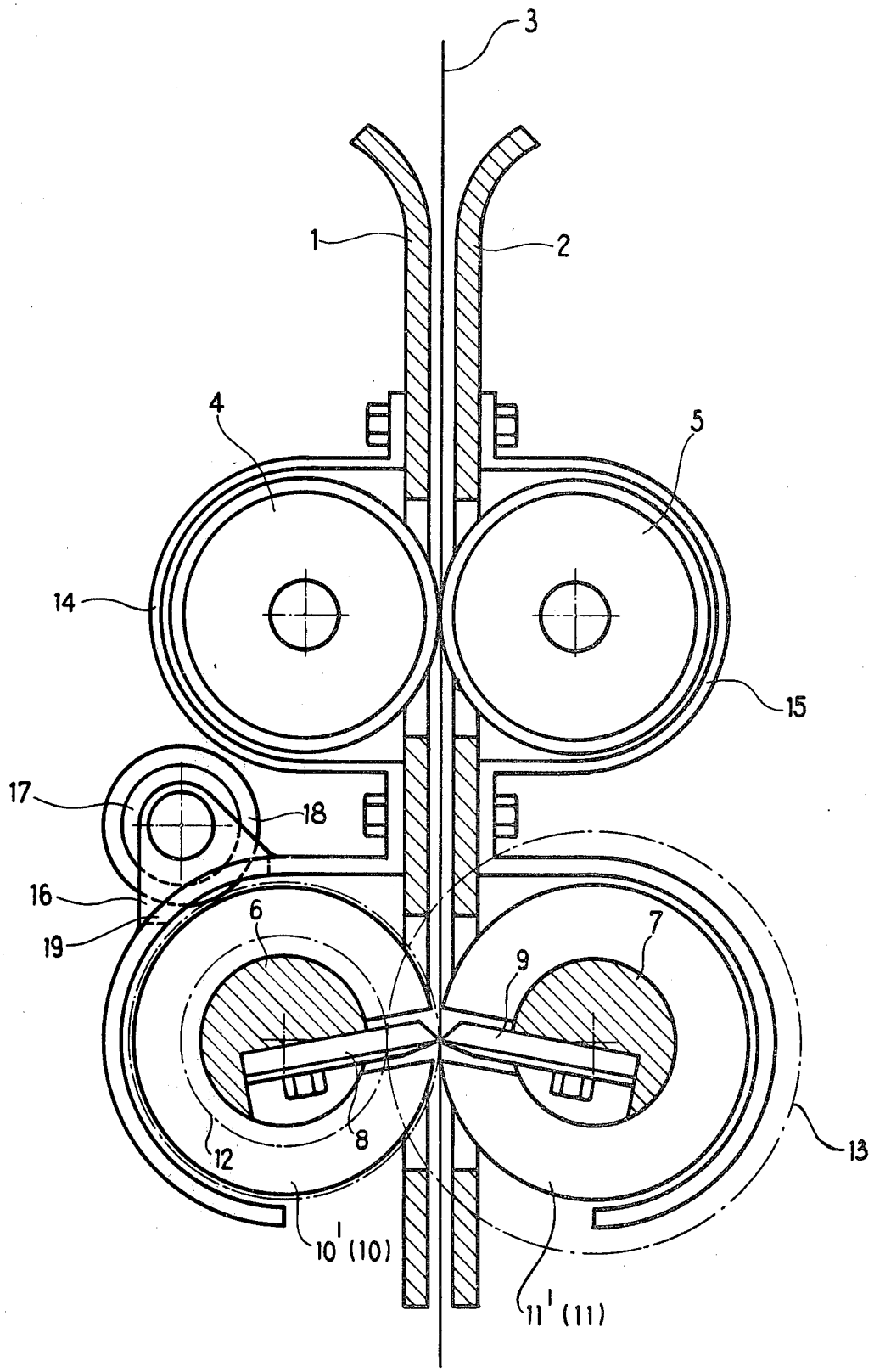
3
1
2
4
5
14
15
17
18
16
19
6
7
9
8
12
13
10' (10)
11' (11)

CLEANING AND LUBRICATING FOIL CUTTER

FIELD OF THE INVENTION

The present invention relates to feed devices for the foil in packet cigarette packers and more particularly to a device with automatic cleaning and lubrication for cutting a roll of foil into lengths.

BACKGROUND OF THE INVENTION

Cigarette packets, whether the type called soft or American or else the hinged lid type, have the inner wrapper, that is the wrapper in direct contact with the cigarettes, made of foil or more precisely a material made up of a paper backing covered on one side with a film of foil.

It is usual for the rectangular lengths of foil that go to make up these inner wrappers to be taken off a continuous roll by means of a cutting device made basically from a couple of blades counter rotating at the same peripheral speed and in reciprocal periodic contact along the roll feed plane.

It is also known that the use of ordinary cutting devices in very high speed cigarette packers, machines of the type described for example in applicant's U.S. Pat. Nos. 3,628,309 and 3,968,115, application 611,885, leads to or even heightens various drawbacks.

At high running speeds particularly serious consequences stem from adhesive forces between the metal foil film and the cutting edge of the blade which is going to sever the roll on the metal coated side.

This drawback which can lead to deviation of the lengths from feed line to packaging mechanisms has been solved as may be seen from applicant's U.S. patent application No. 721,528 by giving the blade a peripheral speed at least twice that with respect to the second blade which is going to cut the roll on the side of the paper backing material.

Indeed the adhesive phenomenon also occurs between the blade cutting the metal film and metal particles or fragments shed from the roll in the course of this operation.

As these fragments accumulate, the cutting capacities of the device gradually lower until along the lines of separation between length and length there soon appear creases or tears.

To resume proper running conditions at this point means performing with the packer in stay position a close and time-consuming cleaning operation on the cutting device.

SUMMARY OF THE INVENTION

The purpose of the invention is to make an improved cutting device able to function at the high running speeds of packers of the type described in the patents cited above, without giving rise to the drawbacks due to the adhesive forces between metal roll and cutting blade. A further purpose of the present invention is to make a particularly simple and economical device.

These and yet other purposes are all achieved with the device of the present invention for cutting into lengths a roll of foil in packet cigarette packers. One or more couples of wheels provide for continuous roll feed along and between guides. A couple of cutting blades are counter positioned on the down side of the feed wheels of which one at least possesses continuous rotatory movement round an axis parallel to the same feed wheels. The device includes a pad of absorbent material pre-soaked in vaseline oil, a lubricant.

BRIEF DESCRIPTION OF THE DRAWINGS

Further features and advantages will become more apparent from the detailed description that follows of a preferred but nonexclusive embodiment of the present invention, illustrated for the sake of example only in the annexed single diagram which presents the front view, with some parts in cross section or removed in order to show others better, of an apparatus for feeding and cutting into lengths a roll of foil comprising the device of the present invention.

DESCRIPTION OF THE PREFERRED EMBODIMENT

The numbers 1 and 2 indicate two vertical and parallel guides between which from top to bottom along a plane termed the feed plane runs a continuous roll 3 of foil, the metal coated face of which is to the left as you look at the figure.

Along the feed plane corresponding to openings made in the two walls of guides 1 and 2, the roll 3 then inserts itself between two wheels 4 and 5 counter rotating round horizontal axes which makes it turn from a winder not shown in the figure.

On the down side of this couple of wheels 4 and 5 there lies a device of known type described in applicant's patent application No. 721,528 cited above for cutting the roll into lengths. This device comprises two spindles 6 and 7 counter rotating parallel to the axes of wheels 4 and 5 and placed on the two sides of the couple of vertical guides 1 and 2 corresponding to the openings made therein.

On these spindles 6 and 7 are mounted respectively blades 8 and 9 of dimensions such as to bring their respective cutting edges into reciprocal contact along the feed plane.

A first and a second couple of discs 10, 11 and ', 11' tangential to each other, the first (not shown in the figure) mounted on the fore ends of the spindles 6 and 7 and the second on their rear ends, serve to guide and accompany the roll corresponding to the cutting position. Further as known, blade 8 which is going to cut the roll on the side covered by the metal film is run at a peripheral speed twice that in respect of blade 9.

Circumferences traced by broken lines 12 and 13 coaxial respectively to spindle 6 and spindle 7 represent diagrammatiically in respect of the said speed ratio the two drive gears for the cutting device.

The length obtained at each cutting operation then descends between guides 1 and 2 and towards its zone of utilisation. Numbers 14 and 15 indicate two guards fixed respectively on guide 1 and guide 2 and so shaped as to incorporate feed wheels 4 and 5 and the cutting device.

To the guard 14 next to the cutting device are joined means of support 16 (only one of which is visible in the figure) for an idler 17 with an axis parallel to spindle 6 covered with a sheath of felt 18 or other material which is pliant and porous, steeped for example, in vaseline oil a lubricant. This wheel is of dimensions such as to bring into contact, through an opening 19 made in the guard 14, its sheath 18 with the cutting edge of blade 8 every time it turns and thus twice for each cutting operation. The periodic wiping action of the felt sheath 18 has shown itself able to maintain the cutting edge of blade 8 in perfectly efficient conditions, stopping any build up of metal fragments on it.

The smear of lubricant which gets onto the cutting edge also has a repellant action on the metal particles which helps their clean up thereafter.

I claim:

1. A device for cutting a roll of foil having a given width and made at least partially of metal into lengths in a packet cigarette packer, the device comprising one or more couples of continuous feed wheels for effecting feed of the foil from said roll along a given path and between fixed guides, a first cutting blade and a second cutting blade having respective cutting edges positioned substantially perpendicularly to said path for severing the foil along its width perpendicular to said path, said first and second blades being counter positioned on the down side of said feed wheels of which at least said first cutting blade possesses continuous rotary movement round an axis parallel to the same feed wheels, and a cylindrical pad of absorbent material supported freely turning round its own axis placed parallel in position such that during its rotating movement the cutting edge of said first cutting blade comes into contact with said cylindrical pad of absorbent material presoaked in lubricant.

2. A device as claim 1 in which said first and second cutting blades are turned on respective axes parallel and counter rotating by means of gears with transmission ratio such that the peripheral speed of the said first cutting blade coming into contact with said cylindrical pad of absorbent material steeped in lubricant is twice that of said second cutting blade, contact of the cutting edge of said first cutting blade with said cylindrical pad occurring twice for every cutting operation.

* * * * *